United States Patent [19]

Hill et al.

[11] Patent Number: 4,595,422

[45] Date of Patent: Jun. 17, 1986

[54] DRILL CUTTING DISPOSAL SYSTEM

[75] Inventors: Kenton C. Hill, Harvey; Darryl A. Schonacher, Labadieville, both of La.

[73] Assignee: CDS Development, Inc., New Orleans, La.

[21] Appl. No.: 609,238

[22] Filed: May 11, 1984

[51] Int. Cl.[4] ..... B08B 3/10; B08B 7/04

[52] U.S. Cl. ..... 134/19; 134/40; 134/105; 134/109; 175/206

[58] Field of Search ..... 134/10, 19, 25.1, 40, 134/105, 108, 109; 175/206, 207

[56] References Cited

U.S. PATENT DOCUMENTS

| | | | |
|---|---|---|---|
| 3,693,733 | 9/1972 | Teague | 175/206 |
| 3,860,019 | 1/1975 | Teague | 175/206 X |
| 4,139,462 | 2/1979 | Sample | 175/206 X |
| 4,175,039 | 11/1979 | Fisher | 134/10 X |
| 4,208,285 | 6/1980 | Sample, Jr. | 175/206 |
| 4,209,381 | 6/1980 | Kelly | 175/206 X |
| 4,222,988 | 9/1980 | Barthel | 175/66 X |
| 4,242,146 | 12/1980 | Kelly, Jr. | 134/40 |
| 4,247,312 | 1/1981 | Thakur et al. | 175/206 |
| 4,255,269 | 3/1981 | Timmer | 175/206 |
| 4,304,609 | 12/1981 | Morris | 134/19 |
| 4,319,410 | 3/1982 | Heilhecker et al. | 175/207 X |
| 4,411,074 | 10/1983 | Daly | 175/207 X |

*Primary Examiner*—George Yeung

*Attorney, Agent, or Firm*—Finnegan, Henderson, Farabow, Garrett & Dunner

[57] ABSTRACT

An apparatus for removing fluids and hydrocarbons in oil well drill cuttings and an apparatus adapted to cooperate with conventional rig shakers for removing a major portion of fluid in the cuttings solids. A major portion of the fluids is removed by shaking the fluids-solids mixture. The solids are agitated by a chemical solution facilitating chemical removal of hydrocarbons in the solids. The solids are placed in an apparatus which shakes the solids at a higher speed than the first shaking, further separating fluids from solids. Fine particles of solids are removed from centrifuging. The separated solids are then discharged from the apparatus for disposal.

14 Claims, 2 Drawing Figures

DRILL CUTTING DISPOSAL SYSTEM

BACKGROUND OF THE INVENTION

This invention relates to a system for separating fluids from solids, drying these solids and in most cases, removing hydrocarbons remaining in the separated solids. More specifically, the invention relates to a drill cuttings disposal system for an oil well drilling operation involving two phases of operation that incorporates two separate units in which components in the first unit are operative in the first phase to separate solids from the fluid and components in the second unit are operative in the second phase to remove fluids remaining in the solids including use of a drying process.

Drilling operations are continually involved with the problem of disposing of drill solids sometimes referred to as cuttings. These cuttings always contain fluids and often contain hydrocarbons because of contact with formation oil and use of lubricating oils in the drilling operation. Federal regulations prevent discharge of the cuttings in waters in environmentally sensitive areas and in any controlled waters where the cuttings contain hydrocarbons in an amount that would cause an oil sheen on the water. State regulations are often more restrictive than federal rules and may completely preclude discharge of cuttings at the drill site. The problem of disposing of drill cuttings is further aggravated by the fact that it is anticipated that both federal and state regulations will become more stringent in the future.

Presently known systems include methods of separately washing cuttings in a detergent, steaming off a portion of the hydrocarbons, or heating the cuttings to remove a portion of hydrocarbons. These systems are usually bulky and consequently difficult to move to and mount at the drill site. They are also relatively inefficient and therefore expensive to operate. Most importantly, these systems are incapable of reducing hydrocarbon content by volume to an acceptable level permitting discharge of drill cuttings into surrounding waters. In sum, none of the presently known systems are both economically and technically feasible.

An obvious significant economical advantage of this invention is that it processes and drys cuttings at the drill site permitting easy disposal of the cuttings. Federal regulations permit offshore disposal of cuttings provided there is no discharge of free oil from the cuttings; that is, if a discharge does not cause a film or sheen upon or a discoloration on the surface of the water or adjoining shorelines or causes a sludge or emulsion to be deposited beneath the surface of the water or upon adjoining shorelines (40 C.F.R. Sub. 435.11(d)).

The present invention will reduce hydrocarbon levels in cuttings to comply with these federal standards. If more stringent state regulations are applicable then the invention will dry the cuttings making their handling and transportation to onshore disposal sites significantly easier and less expensive than under current methods of disposal. Similar principles are applicable for onshore drilling operations.

SUMMARY OF THE INVENTION

The present invention overcomes the problems and disadvantages of the prior art by providing a system that economically and efficiently removes hydrocarbons from drill cuttings. The system includes two phases. The first phase, through mechanical and chemical processes, removes a major portion of the hydrocarbons from the cuttings. The second phase involves heating the cuttings and thereby vaporizing substantially all of the hydrocarbons out of the cuttings. The heating phase dries the cuttings permitting efficient packaging and handling for removal to onshore disposal sites.

Accordingly it is a primary object of this invention to provide a method and apparatus for separating solids from the fluids, reducing hydrocarbon content in the solids, and drying the solids.

It is a further object of this invention to provide a method and apparatus capable of reducing hydrocarbons and drill cuttings in offshore oil well drilling operations to a level within regulatory standards controlling discharge of material into adjacent waters.

A futher object of this invention is the provision of a compact drill cuttings fluid and hydrocarbon removal apparatus that is relatively easily moved about an offshore or onshore drilling rig. A still further object of the subject invention is the provision of drill cuttings fluid and hydrocarbon removal apparatus which includes a precisely controlled heater assembly removing substantially all fluids and hydrocarbons in an efficient manner.

Another object of the invention is the provision of a variable speed conveying system which will subject the solids, containing fluids and hydrocarbons, to a predetermined temperature at a rate of movement through a heating assembly, which is sufficient to ensure substantial removal of fluids and hydrocarbons, thus permitting on site discharge of cuttings.

A further object of this invention is the provision of an efficient method of separating solids from a fluid in removing hydrocarbons from the solids.

Another object of this invention is the provision of a method of removing hydrocarbons from offshore or onshore oil well drill cuttings.

A further object of this invention is the provision of a method of separating solids from water in oil well drilling cuttings and removing substantially all hydrocarbons from the solids for discharge into adjacent waters or at other on site locations.

A still further object of this invention is the provision of a continuous method of drying and packaging cuttings, permitting efficient transportion and disposal of the cuttings at on-shore location or other distant locations.

Additional objects and advantages of the invention will be set forth in part in the description which follows, and in part will be obvious from the description or may be learned by practice of the invention. The objects and advantages of the invention may be realized and obtained by means of the instrumentalities and combinations particularly pointed out in the appended claims.

To achieve the foregoing objects in accordance with the purposes of this invention, as embodied and broadly described herein, the apparatus and method of removing fluids and hydrocarbons from solids comprises steps and means for initially removing a major portion of fluid contained by drill solids being treated; means for breaking solids into particles; chemically reducing hydrocarbons in the solid particles; means for removing fluid remaining in the solid particles; means for further removing solid particles from the remaining fluids; means for combining and conveying all of the solids to a heating assembly; and moving the solids through a heating unit at a controlled, variable rate of speed sufficient to reduce volume of fluids and hydrocarbons in the solids to near zero.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Figure 1:
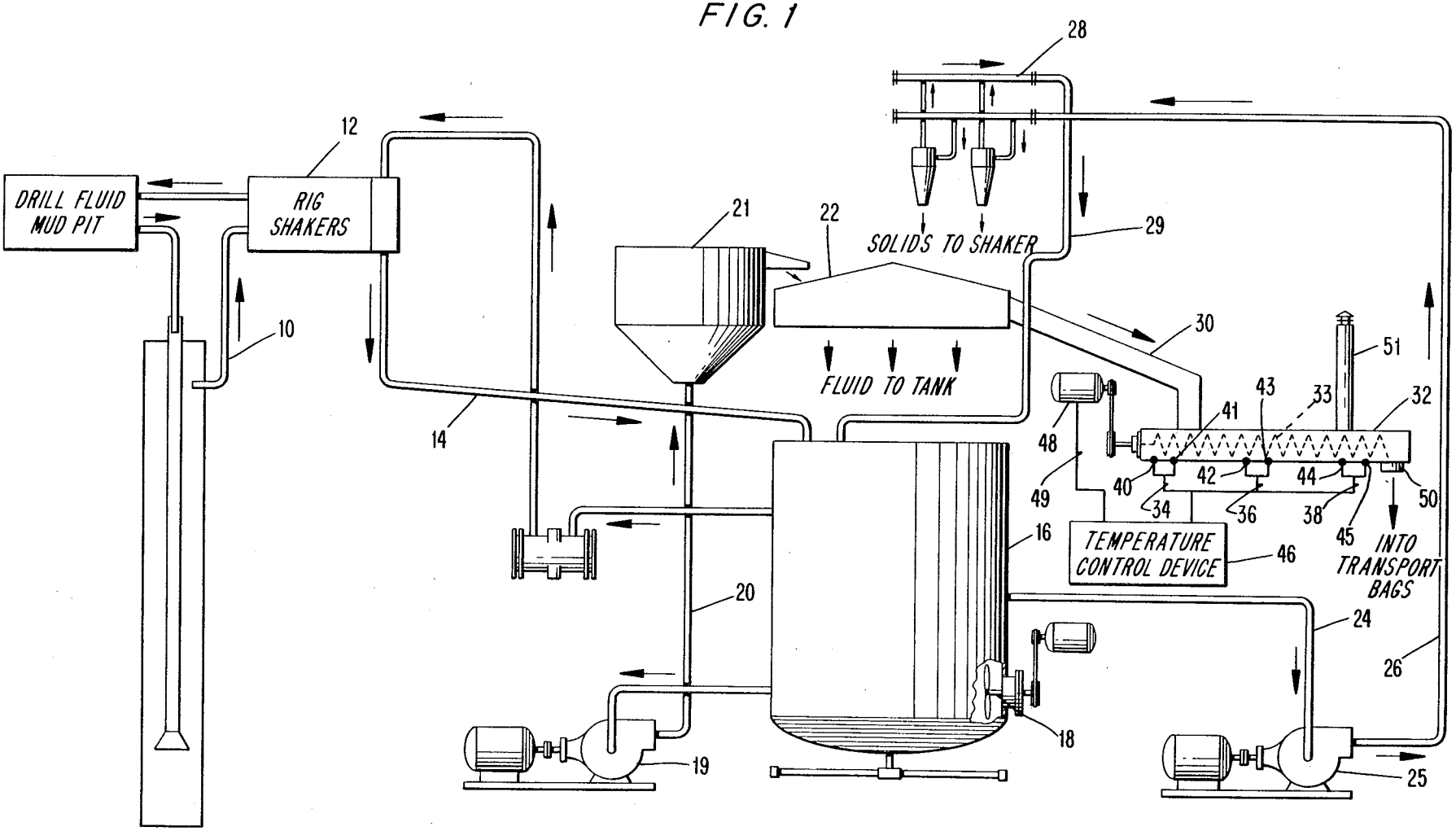
FIG. 1 is a schematic diagram illustrating apparatus components and sequence of process steps of the subject invention.
Figure 2:
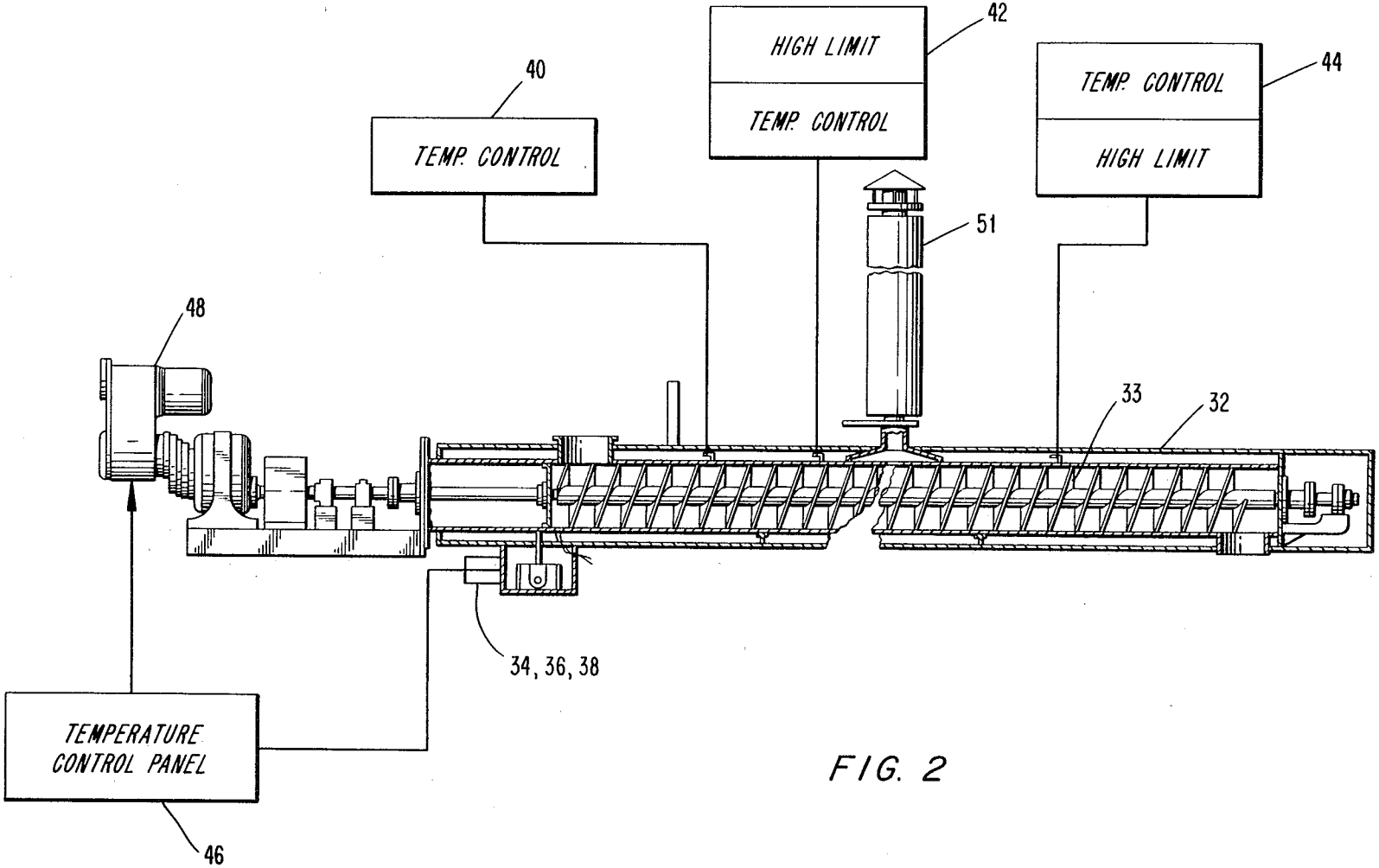
FIG. 2 is a plan view, partly in section, illustrating a heating assembly utilized by the subject invention.

With reference to FIG. 1, a preferred embodiment of the invention is shown wherein a supply pipe 10 conducts a fluid-solids mixture, which can be drill cuttings contaminated with hydrocarbons from either lubricating oils or oil in the formation, from a drill hole for treatment. In accordance with the invention, the cuttings are first transferred to shaking or vibrating means 12, conventional in form and located in the drill rig, for removing a major portion of the fluid from solids in the mixture. The drill solids are then transferred by a washdown line 14 to a cuttings disposal system (CDS) tank 16 associated with high speed agitating means 18 located in the lower portions of tank 16. In accordance with the invention, agitating means 18 is a conventional high speed agitator operating in the range of 900 to 1800 rpm. The high speed agitation of cuttings solids in CDS tank 16 breaks the cuttings into small particles making it possible to expose more surface area presented by the small particles to subsequent chemical treatment.

As embodied herein, chemical reduction of hydrocarbons associated with the solids results from exposing the solids to a detergent solution, such as dispersants & de-emulsifiers. Of course, the particular chemical treatment will vary with the type of drill cuttings of mud obtained in the drilling operation. When detergent solutions are used, they are a mixture of degreasing solutions containing low mole surfactants, solvents and emulsion breakers-conventionally known in the field of this invention. The precise mixture will be tailored to be effective with specific drill cuttings compositions. Normally, these detergent solutions will react with hydrocarbons and oils removing a major portion of the content during this first phase of the removal process. In fact, at this stage the treatment usually reduces the hydrocarbon content from approximately 30% by volume to a range of 6–10% by volume.

Larger drill solids are extracted from CDS tank 16 and conveyed by pump 19 through conduit 20 to a spreading means. As embodied herein, the spreading means comprises a spreading mechanism 21, known in the field of this invention as a "possum belly," which distributes the larger solids and fluids from tank 16 onto high speed shaker or vibrator means. In accordance with the invention, high speed shaker or vibrator means comprises shaker device 22. Any fluid remaining in the solids is removed by shaker 22 and returned to CDS tank 16 through filtering screens, not shown, embodied within the high speed shaker 22.

Centrifuging means are provided to receive fluid returned from high speed shaker 22 for further separating solids from the fluid. In accordance with the invention, the centrifuging means comprises a conventional centrifuging device which can be in the form hydroclone 28. Fluid removed by shaker 22 is returned to tank 16 and drawn therefrom by pump 25 through inlet conduit 24. The pump pressurizes the fluid forcing it through conduit 26 to hydroclone 28. Centrifuging the fluid cause any fine particles of solids remaining in the fluid to be separated and discharged to shaker 22. Cleaned fluid exiting hydroclone 28 passes through conduit 29 back to CDS tank 16. By this process, the fluid initially discharged from high speed shaker 22 is further cleaned because hydroclone 28 removes fine solids not screened by shaker 22. Should the solids be sufficiently free of hydrocarbons at this stage, they could be discharged from the system. This would then conclude the first stage of the process. However, if the solids are still not in compliance with prevailing regulations (and they rarely, if ever, will be) they can be continued in the process and enter the second stage thereof.

After receipt of the fine solids, high speed shaker 22 can then discharge both the larger and fine particle solids through a tapered chute 30 to a vaporizing means operable to vaporize any remaining fluids and hydrocarbons in the solids. In accordance with the invention, the vaporizing means is in the form of a heater assembly 32 which can be a type incorporating an internal helical auger 33 moving the solids through the assembly at a controlled rate of axial speed. The heater assembly is of an insulated double walled type construction providing thermal efficiency and includes an exhaust stack 48 for discharge of vaporized hydrocarbons and any steam that may be generated while drying the solids. In preferred form, heating assembly 32 is heated by six electrical resistance heating elements 40, 41, 42, 43, 44 and 45, which are shown schematically in FIG. 1. The heating elements are connected to a conventional temperature control system 47 placed within a panel 46 by leads 34 and 36. Each of the leads supply source current to three heating elements respectively, as shown in FIG. 1; the third lead 38 is to a thermocoupler linking sensin probes to the temperature control panel. Temperature control panel 46 is also connected with auger motor 48 by lead 49 regulating the rotational speed of auger 33 in accordance with the temperature of the solids being conveyed.

In operation of the second stage, solids supplied through tapered chute 30 are moved through heater assembly 32 by auger 33 at temperature regulated rate of speed. Temperature of the solids is measured by probes associated with each of the heating elements 40, 41, 42, 43, 44 and 45. Obviously it is not necessary to place the temperature sensing probes at the locations of energy supply to the heating elements. The temperature probes can be positioned at any desired location for efficiency purposes. Control system 47 maintains the temperatures of the resistance heating elements at a predetermined temperature. Presetting the control system 47 ensures the solids being subjected to a predetermined temperature for a sufficient time period to substantially vaporize all fluids and hydrocarbons remaining in the solids as they pass through heater assembly 32. The vaporized fluids and hydrocarbons are exhausted through exhaust stack 48 while the solids exit conduit 50 where they can be discharged on site or bagged for offsite disposal if necessary.

Of course the time and temperature necessary to vaporize the fluids and hydrocarbons from particular drill cuttings will vary with the composition of the cuttings. It is also apparent that the length of heater assembly 32, the number and size of the heating elements and the rate of movement of the solids through the heater can be varied as prevailing circumstances require. It has been found that cuttings can be heated to a sufficient temperature to remove all but one-half of one percent of the hydrocarbons. Cuttings with this hydrocarbon content can generally be disposed of at the drilling site as they fall within federal and most state standards. Despite of where the cuttings are disposed of, the drying process permits economical handling, transportation and disposal. An exemplary form of heater assembly 32 includes a double wall tubular outer casing with six heating elements embedded at equidistant locations along the longitudinal axis. Each of these elements have a 1500° F. heating capacity. Heat is transferred directly to the interior of the assembly through the inner walls, which can be designed to enhance heat transfer to the cuttings.

A modified form of the heater assembly 32 can include a double walled casing member having channels or tubular coils disposed therein for receipt of a heated fluid. The fluid can be heated in a vessel adjacent to the unit by elements similar to those incorporated in the preferred form. The heated fluid is then pumped through the channels or coils in the walls at a regulated temperature supplying required heat to solids passing through the heater assembly.

It will be apparent to those skilled in the art that various modifications and variations could be made in the components of the subject system without departing from the scope or the spirit of the invention. In particular various materials could be utilized to form the components of the subject system without departing from the scope of the invention, the only limitation being that the materials used have characteristics permitting them to withstand vibrations and heat generated during separation and heating while operating the drilling cuttings disposal system.

What is claimed is:

1. A method of removing fluids and hydrocarbons in a fluids-solids mixture comprising the steps of:

(a) shaking the mixture removing a major portion of the fluids from the fluids-solids mixture;

(b) immersing the solids in a tank containing a chemical solution capable of removing hydrocarbons from the solids;

(c) agitating the solids in the chemical solution in the tank to facilitate the chemical removal of hydrocarbons from the solids and to break the solids into smaller particles;

(d) shaking the solids from the tank at a higher speed than the first shaking to further separate fluid from solids;

(e) centrifuging fluid removed by said high speed shaking removing fine particles of solids;

(f) heating the solids to vaporize off substantially all of the remaining fluids and hydrocarbons from the solids; and (g) discharging all of said solids for disposal.

2. A method of removing fluids and hydrocarbons in a fluids-solids mixture as described in claim 1 further comprising the steps of:

spreading the solids upon said high speed shaker prior to shaking and further removing fluid.

3. A method of removing fluids and hydrocarbons in a fluids-solids mixture as described in claim 1 further comprising the step of:

discharging centrifuged fine solids partiles into the high speed shaker; and discharging all solids from the high speed shaker for disposal.

4. A method of removing fluids and hydrocarbons from oil well drill cuttings comprising the steps of:

(a) conveying the cuttings to a first shaker device;

(b) shaking the cuttings removing a major portion of fluids from solids in the cuttings;

(c) conveying the cuttings to a cuttings disposal systems tank containing an agitator in the lower portions thereof;

(d) agitating the cuttings solids breaking them into small particles;

(e) agitating the solids in a chemical solution in the tank reducing the hydrocarbon content in the solids;

(f) spreading the solids on a second speed shaker device;

(g) pumping this latter remaining fluid removed from the solids to a centrifuging device;

(h) centrifuging any solids left in the remaining fluid separated by the high speed shaking;

(i) heating the solids after discharge from the high speed shaking sufficiently to vaporize off substantially all fluids and hydrocarbons remaining in the solids while simultaneously drying the solids; and (j) discharging all of the solids for disposal.

5. A method of removing fluids and hydrocarbons from oil well drill cuttings as described in claim 4 wherein the chemical solution for reducing hydrocarbon content in the solids is a detergent solution.

6. A method of removing fluids and hydrocarbons from oil well drill cuttings as described in claim 4 wherein shaking of the solids at a high speed is conducted in the range of 900 to 1800 rpm.

7. A method of removing fluids and hydrocarbons from oil well drill cuttings as described in claim 4 further comprising the step of:

regulating temperature and speed of the solids as they pass through a heating assembly ensureing vaporizing of fluids and hydrocarbons in the solids.

8. A method of removing fluids and hydrocarbons from oil well drill cuttings as described in claim 7 further comprising the step of:

discharging the dried solids from the heating device directly into transporting receptacles.

9. An apparatus for removing fluids and hydrocarbons in oil well drill cuttings adapted to cooperate with conventional rig shakers removing a major portion of fluid in the cuttings solids comprising:

(a) a tank for containing a chemical solution capable of removing hydrocarbons from the solids;

(b) means for agitating the cuttings solids in the tank reducing the solids to small particles in the solution and chemically reducing the hydrocarbon content in the solids;

(c) means for shaking the solids at relatively high speed removing fluid remaining the the solids;

(d) means for centrifuging the remaining fluid separated causing fine solid particles to be removed from the fluid;

(e) a heater assembly heating the solids sufficiently to vaporize all fluids and removing substantially all hydrocarbons remaining in the solids; and (f) means discharging the solids from said high speed shaking means.

10. An apparatus for removing fluids and hydrocarbons in oil well drill cuttings as described in claim 9 further comprising means for spreading solids onto said high speed shaking means.

11. An apparatus for removing fluids and hydrocarbons in oil well drill cuttings as described in claim 9 further comprising:

means associated with said centrifuging means directing solids from said centrifuging means to said high speed shaking means.

12. An apparatus for removing fluids and hydrocarbons in oil well drill cuttings as described in claim 9 further comprising:

control means electrically controlling temperature of the solids and rate of movement through said heater assembly.

13. An apparatus for removing fluids and hydrocarbons in oil well drill cuttings as described in claim 12 wherein:

a rotatable auger is rotatably mounted within said heater assembly and an electric motor driving said auger is regulated by said control means.

14. An apparatus for removing fluids and hydrocarbons in oil well drill cuttings as described in claim 13 wherein:

means for discharging the solids into receptacles for transportation handling can be selectively attached to said heater assembly.

* * * * *